US010304357B2

(12) United States Patent
Pizzi

(10) Patent No.: US 10,304,357 B2
(45) Date of Patent: May 28, 2019

(54) LABEL-HOLDER ELEMENT FOR ELECTRICAL TERMINAL BLOCKS

(71) Applicant: Morsettitalia S.p.A., Milan (IT)

(72) Inventor: Giordano Pizzi, Milan (IT)

(73) Assignee: MORSETTITALIA S.P.A., Milan (IT)

( * ) Notice: Subject to any disclaimer, the term of this patent is extended or adjusted under 35 U.S.C. 154(b) by 194 days.

(21) Appl. No.: 15/298,629

(22) Filed: Oct. 20, 2016

(65) Prior Publication Data

US 2017/0117643 A1 Apr. 27, 2017

(30) Foreign Application Priority Data

Oct. 21, 2015 (IT) ..... 102015000063843

(51) Int. Cl.

| | |
|---|---|
| ***G09F 3/20*** | (2006.01) |
| ***H01R 9/24*** | (2006.01) |
| ***H01R 13/46*** | (2006.01) |
| ***H01B 7/36*** | (2006.01) |
| ***G09F 3/08*** | (2006.01) |

(52) U.S. Cl.

CPC ..... *G09F 3/205* (2013.01); *G09F 3/08* (2013.01); *H01B 7/368* (2013.01); *H01R 9/2475* (2013.01); *H01R 13/465* (2013.01)

(58) Field of Classification Search

CPC ... G09F 3/205; G09F 3/08; G09F 3/20; H01R 9/2475; H01R 13/465

See application file for complete search history.

(56) References Cited

U.S. PATENT DOCUMENTS 5,080,607 A * 1/1992 Cristescu ..... H01R 9/2683 439/491
5,613,874 A * 3/1997 Orlando ..... H01R 13/465 40/607.13

(Continued)

FOREIGN PATENT DOCUMENTS

DE 973473 C 3/1960
DE 8506254 U1 7/1985

(Continued)

OTHER PUBLICATIONS

Vautrin, F; Search report & written opinion from priority Italian Application No. 102015000063843; search completed Jun. 21, 2016.

(Continued)

*Primary Examiner* — Gary C Hoge

(57) ABSTRACT

Label-holder element for electric switchboard terminal blocks (100), comprising a body (10;110;210;310;410) extending in a longitudinal lengthwise direction (X-X), transverse widthwise direction (Y-Y) and vertical thickness direction (Z-Z), with a front face (10*a*) provided with a seat (20) for labels (30), side faces (10*b*) and a rear face (10*c*;110*c*;210*c*;310*c*;410*c*), said seat (20) having a top edge (20*a*) and bottom edge (20*b*) arranged opposite each other in the longitudinal direction (X-X) and formed with engaging means (21,22;521,522) for a label (30), and means (40;140;240) projecting outwards from the rear face of the body (10), with an elasticity in the longitudinal direction (X-X) and suitable for coupling with means (101,100;210) for supporting the label-holder element on a terminal block (100;1100).

7 Claims, 5 Drawing Sheets

(56) References Cited

U.S. PATENT DOCUMENTS

Figure 1:
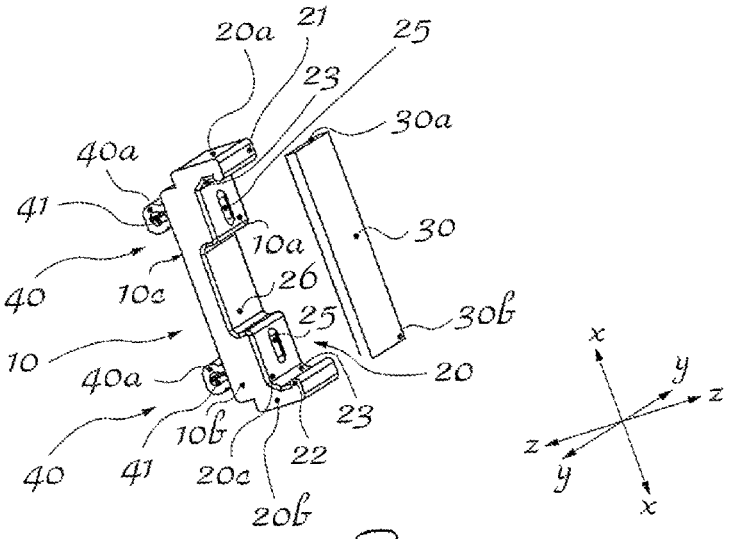

| | | | | |
|---|---|---|---|---|
| 2010/0024984 | A1* | 2/2010 | Mercier-Gallay | G09F 3/16 156/391 |
| 2011/0183542 | A1* | 7/2011 | Pizzi | H01R 9/2683 439/491 |
| 2015/0040447 | A1* | 2/2015 | Ganster | G09F 3/0295 40/647 |
| 2017/0054231 | A1* | 2/2017 | Adams | B31D 1/02 |

FOREIGN PATENT DOCUMENTS

| | | | |
|---|---|---|---|
| DE | 3932066 | C1 | 11/1990 |
| DE | 202004010070 | U | 11/2005 |
| DE | 202008013609 | U | 11/2009 |
| DE | 202009003250 | U1 | 7/2010 |
| FR | 76932 | E | 12/1961 |
| JP | S60112278 | U | 7/1985 |

OTHER PUBLICATIONS

Vautrin, F; Search report & written opinion from corresponding European Application No. 16194744.5; search completed Mar. 6, 2017.

* cited by examiner

LABEL-HOLDER ELEMENT FOR ELECTRICAL TERMINAL BLOCKS

The present invention relates to a label-holder element for electric switchboard terminal blocks. It is known, in the technical sector relating to the construction of switchboards for the wiring of electrical installations, the use of terminal blocks adapted to be mounted on associated mounting rails and to provide access on the front to the means—normally of the screw type—for retaining the electrical connection wires which form the electric circuit.

It is also known that, owing to the increasingly greater complexity of electric switchboards, it is necessary to mount on each terminal block a corresponding identification label which must be visible at the front for reading by the user.

For this purpose, for example, EP 2,355,251 in the name of the same present Applicant discloses terminal blocks for electric switchboards which have a suitable front seat for containing a label.

It is also known, however, that on the market there exist different types of terminal blocks which each have a different seat for receiving the label or even do not have such a seat, with the result that it is not possible to standardize said seat, resulting in evident wastage of material, the need for stocks of different types of labels, as well as different types and sizes of the writing to be applied on them.

DE 85 06 254 U1 describes a label holder which has opposite sides in a transverse widthwise direction. Each side has a fold suitable for retaining the label in said transverse direction; the label must consequently be inserted along the longitudinal lengthwise direction of the label holder. The label holder has means which project outwards from its surface and which are rigid and oriented in the same longitudinal direction.

DE 20 2009 003250 U1, FR 76 932 E and DE 973 473 E also describe a label holder which has opposite sides in transverse widthwise direction. Each side has a fold suitable for retaining the label in said transverse direction; the label must be inserted along the longitudinal lengthwise direction of the label holder.

DE 20 2004 010070 U1 describes a label with coupling means projecting from a surface thereof.

The technical problem which is posed therefore is that of providing a label-holder element which is able to allow easy and safe coupling with/uncoupling from different types of electric terminal block, while ensuring the features of safety, prevention of accidental removal of the label and good visibility of the label by the user.

In addition it is also desired to achieve a greater standardization of the label and the associated writing.

In connection with this problem it is also required that the label-holder element should be easy and low-cost to produce and that it may be quickly mounted on/removed from the terminal block.

These results are obtained according to the present invention by a label-holder element for electric switchboard terminal blocks, comprising a body extending in a longitudinal lengthwise direction, transverse widthwise direction and vertical thickness direction, wherein the body includes:

- a front face provided with a seat for labels;
- a rear face opposite the front face in the vertical direction;
- side faces opposite to each other in the transverse direction;
- at least one pair of teeth for coupling with a terminal block, extending outwards from the rear surface of the body.

Each tooth has an elasticity in the longitudinal direction suitable for allowing the tooth to flex elastically in the longitudinal direction.

The seat has a top edge and a bottom edge arranged opposite each other in the longitudinal direction and configured for engaging a label and is open laterally in the transverse direction on at least one side to allow insertion/extraction of a label from at least one side of the seat.

The top edge and the bottom edge may each have a respective tooth for engaging the label, wherein each tooth forms a corresponding undercut towards the inside of the seat.

Each tooth of the seat may preferably extend over the entire width of the seat in the transverse direction.

The oppositely arranged teeth of the seat may have a rounded edge.

Each tooth of at least one pair of coupling teeth may preferably have the form of an elongated "C" and an internal cavity situated between the arms of said "C", so to provide the coupling teeth with the desired elasticity.

At least two coupling teeth may be arranged opposite each other and projecting outwards from the rear face obliquely with respect to the vertical direction.

The element may preferably comprise a base extending outwards and in turn comprising a central body in which two recesses suitable for coupling with the reliefs of an underlying label-holder element are formed.

The top and bottom edges of the seat may be formed so as to define a block which has an internal cavity open laterally on one of the two sides of the body and extending in the transverse direction as far as a blind bottom face formed by the other side of the body, for engaging a label. The said internal cavity may be shaped in the manner of a first substantially trapezoidal space connected to a second substantially I-shaped space. The said first trapezoidal space has preferably inclined sides designed to interfere with a lateral relief of a head of a tooth projecting from the bottom surface of a label.

The rear face of the body has preferably an inclined contact surface, with an inclination from the outside towards the inside of the body in a plane parallel to the longitudinal and vertical directions.

At least one relief may extend in the vertical direction on the front surface of the seat, preferably arranged in a central position with respect to the transverse extension of the seat.

The seat is preferably open on both sides in the transverse direction for inserting the label from one side or the other side.

The front surface of the seat may comprise a depression.

Figure 2:
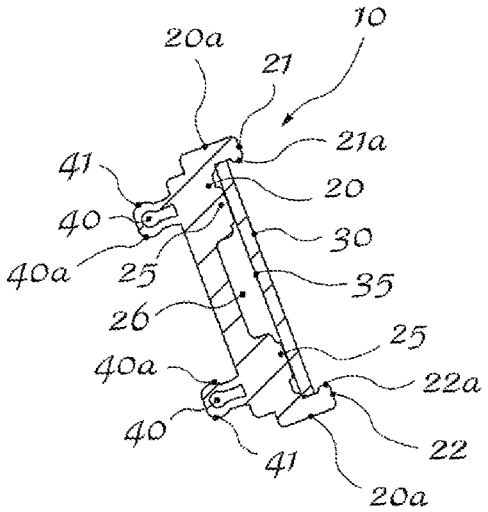
Figure 3:
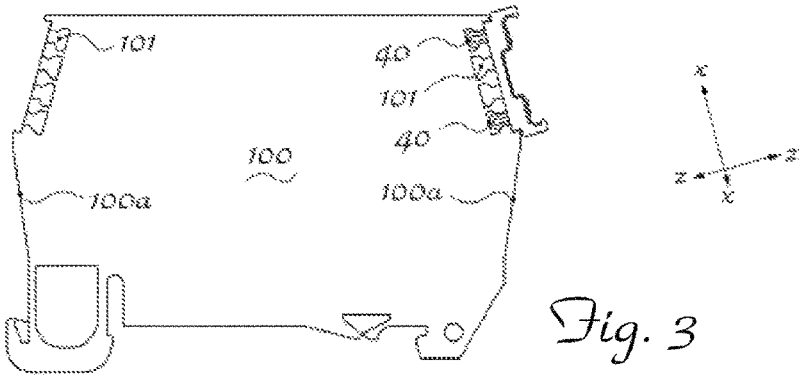
Figure 5A:
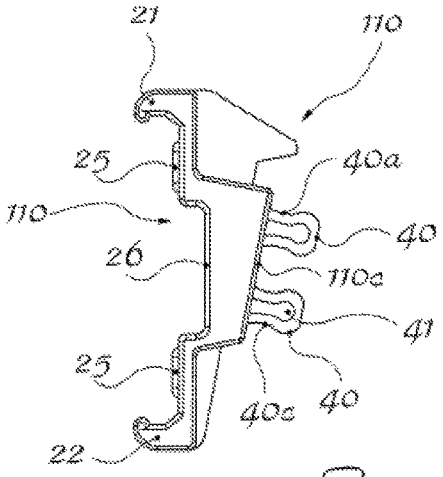
Figure 5B:
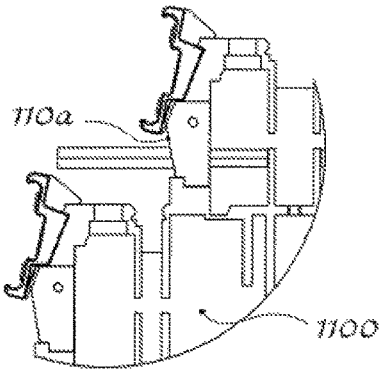
Figure 6:
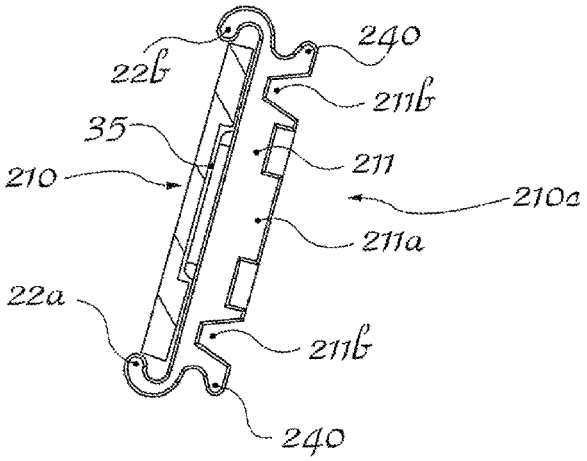
Figure 7:
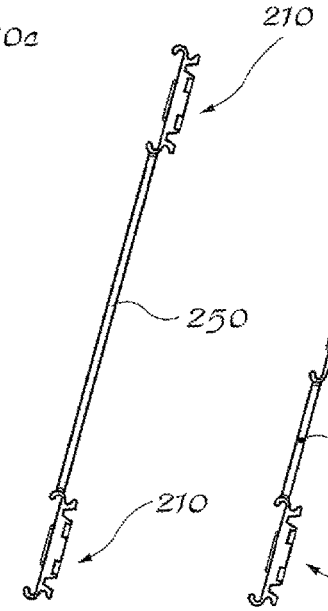
Figure 8:
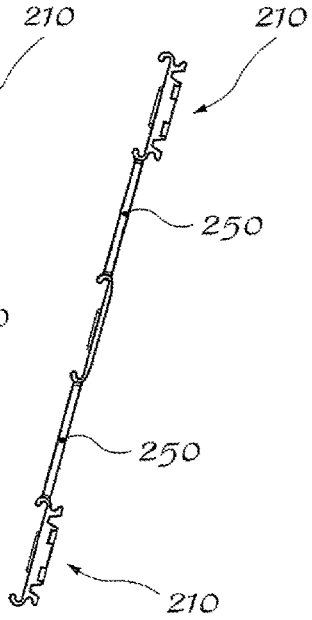
Figure 9:
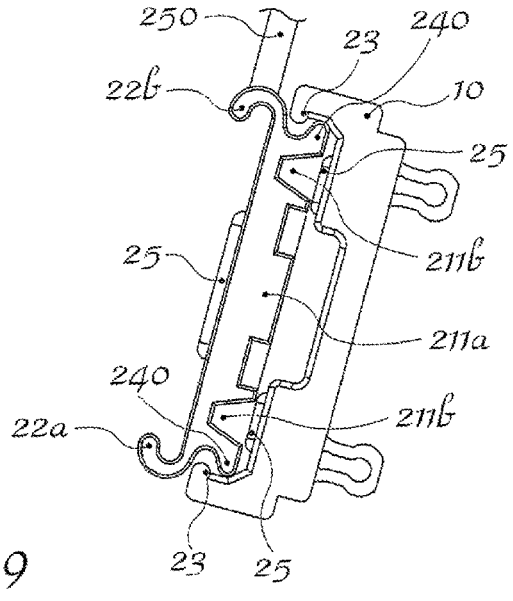
Figure 10:
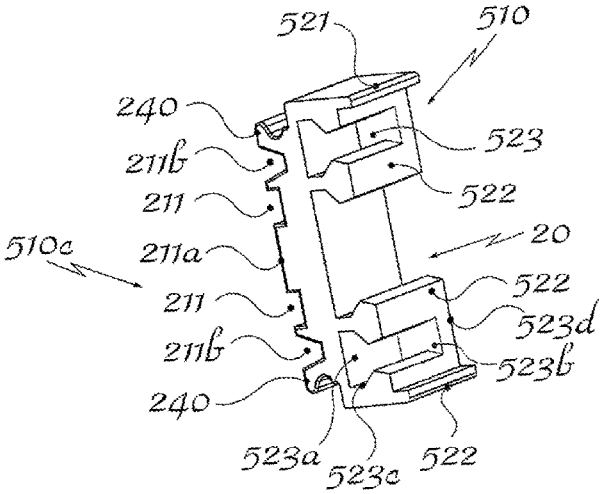
Figure 11:
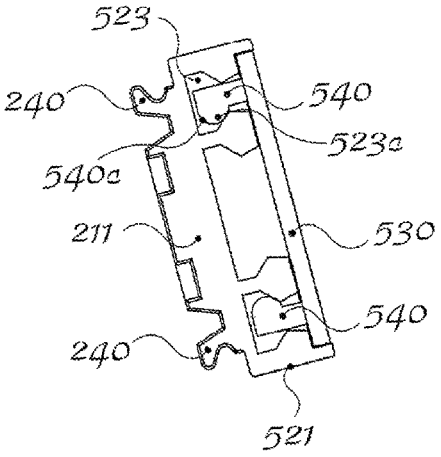
Figure 12:
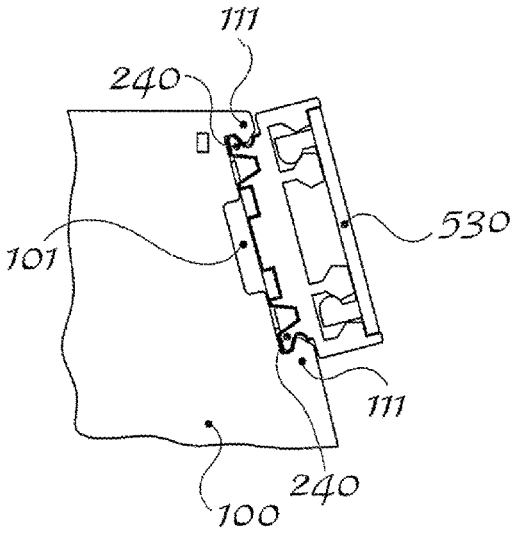
Figure 13:
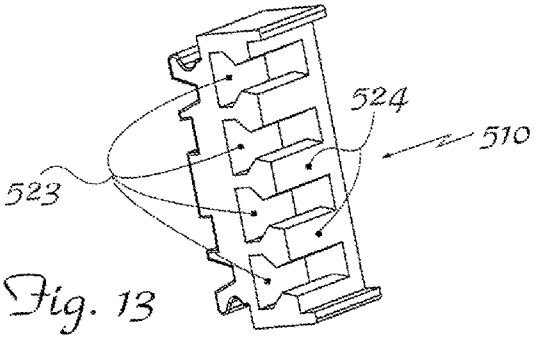
Figure 14:
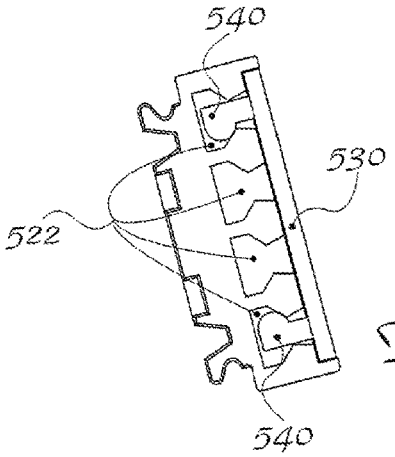
Figure 15:
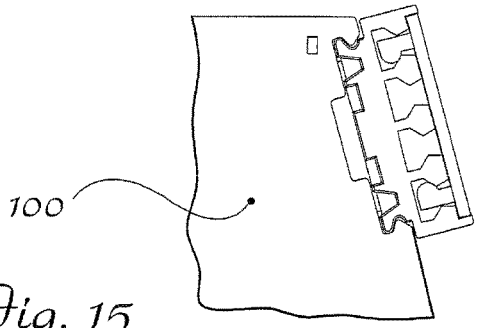
Figure 16:
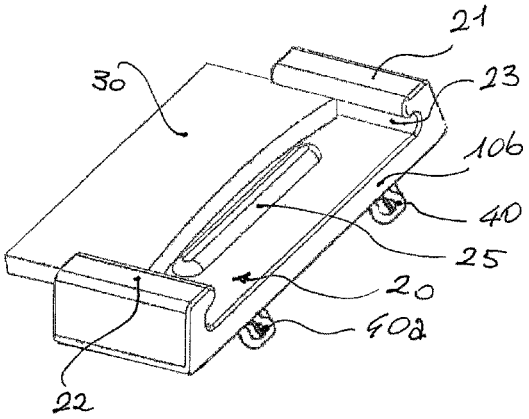

Further details may be obtained from the following description of non-limiting examples of embodiment of the subject of the present invention, provided with reference to the accompanying drawings, in which:

FIG. 1: shows a perspective view of a first example of embodiment of a label-holder element according to the present invention;

FIG. 2: shows a schematic cross-section through the label-holder element according to FIG. 1;

FIG. 3: shows a side view of the label-holder element according to the present invention mounted on a switchboard terminal block;

FIG. 4: shows a partially sectioned side view of the label-holder element mounted on different types of terminal block;

FIGS. 5*a*,5*b*: show side views, respectively, of a second example of embodiment of the label-holder element according to the invention and a terminal block mounted on said label-holder element;

FIG. 6: shows a side view of a third embodiment of the label-holder element according to the invention;

FIGS. 7,8: show side views of examples of mounting of the label-holder element according to FIG. 6;

FIG. 9: shows a partially sectioned view of the label-holder element according to FIG. 6, mounted on the label-holder element of FIG. 1;

FIG. 10: shows a side view of a fourth example embodiment of the label-holder element according to the invention;

FIG. 11: shows a side view of the label-holder element according to FIG. 10 with the label mounted;

FIG. 12: shows the label-holder element with the label according to FIG. 11 mounted on a terminal block;

FIGS. 13,14,15: are figures similar to FIGS. 10-12 showing a variation of embodiment of the label holder according to FIG. 10; and FIG. 16: shows a schematic perspective view of lateral insertion of a label from one side of a seat of a label holder according to the invention.

As shown in FIG. 1 and assuming solely for easier description and without a limiting meaning a set of three reference axes having, respectively, a longitudinal direction X-X corresponding to the greater dimension or length of the label-holder element and the label; transverse direction Y-Y corresponding to the smaller dimension or width of the label-holder element and the label; vertical direction Z-Z corresponding to the thickness of the label-holder element and perpendicular to the first two axes, and a front or end side corresponding to the face for containing and reading the label and a rear face opposite to the front face, a first example of the label-holder element according to the present invention comprises:

- a body 10 with a front face 10*a*, rear face 10*c*, opposite to the front face in the vertical direction Z-Z, and side faces 10*b* opposite to each other in the transverse direction Y-Y;
- a seat 20 for holding the label 30, formed in the front side 10*a* of the body 10, which seat has a top edge 20*a* and bottom edge 20*b* arranged opposite each other in the longitudinal direction X-X and formed in the manner of a respective tooth 21,22 extending in the transverse direction Y-Y over the width of said seat 20.

Each tooth forms a corresponding undercut 23. Preferably said teeth 21,22 arranged opposite each other have an edge 21*a*,22*a* suitably rounded to facilitate a frontal insertion of the label 30.

The seat 20 is open laterally in the transverse direction Y-Y on at least one side so as to also allow a lateral insertion of the label 30 in addition to insertion from the front.

According to a first preferred embodiment (FIGS. 1,5*a*) the front surface 20*c* of the seat 20 is provided with a depression 26 for allowing the label to bend with an inwards convexity in order to facilitate frontal insertion and engagement inside the opposite undercuts of the seat.

According to preferred embodiments at least one relief 25 is formed (FIG. 16), said relief being arranged on the bottom of the cavity 20;

in the embodiments with the depression 26 of the cavity 20 (FIG. 1) two reliefs 25 are arranged on the outside of the depression 26 and symmetrically relative thereto in the longitudinal direction X-X.

The inner front face 30*c* of the label also has preferably formed therein at least one cavity 35 (FIGS. 4,6) extending in the vertical direction Z-Z and having a depth substantially corresponding to the height of the relief(s) 25 of the seat 20 in the element 10, so as to allow stable relative engagement and prevent any sliding of the label in the transverse direction Y-Y, once the label 30 has been correctly engaged inside the undercuts 23.

The rear face 10*c* of the label-holder element is provided with means 40 for coupling with supporting devices on which an identification label 30 must be mounted.

In a first embodiment (FIG. 3) said supporting means are formed by electric switchboard terminal blocks 100 provided with hollow seats 101 in the visible front surface 100*a* of the said terminal block.

The coupling means of the label-holder element comprise at least two teeth 40 extending outwards in the vertical direction Z-Z from the rear face 10*c* and suitable for coupling with the said seats 101 formed in the front face 100*a* of the switchboard terminal block 100.

Each tooth 40 has an elasticity in the longitudinal direction X-X which allows it to flex along this direction X-X.

In greater detail, the teeth 40 have the form of an elongated "C" with the internal cavity 41, situated between the arms 40*a* of the "C", so as to provide them with a certain degree of elasticity in the longitudinal direction X-X.

In this way, when inserted inside the seat of the terminal block, the arms 40*a* may be elastically deformed, reducing the distance between the arms 40*a* in the longitudinal direction X-X so as to return elastically into the rest configuration once inserted fully inside the seat 101 of the terminal block, thus ensuring stable coupling together of the terminal block and the label-holder element.

Figures 4A, 4B, 4C:
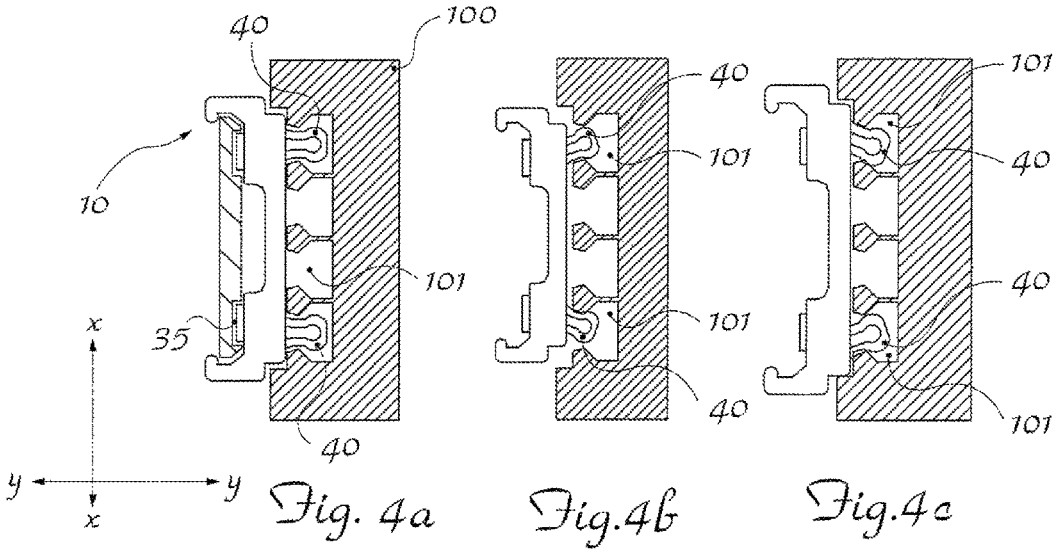

As shown in FIG. 4, the elasticity of the arms 40*a* allows the linear insertion in terminal blocks with seats 101 corresponding to the teeth 40 (FIG. 4*a*), but also insertion in terminal blocks in which the seats 101 have a bigger spacing (FIG. 4*b*), whereby the teeth 40 elastically flex away from each other, or a smaller spacing (FIG. 4*c*), whereby the teeth 40 flex elastically moving towards each other.

FIG. 5*a* shows a second embodiment of the label-holder element where the rear face 110*c* has an inclined contact surface which, according to the directional layout of the figure, has an inclination from the top downwards in the longitudinal direction X-X and from the outside towards the inside of the body 110 in the transverse direction Y-Y; in this way the mounting arrangement may be such (FIG. 5*b*) as to allow in relation to the user a preferred direction of viewing, also from above, by the user, also in the case of terminal blocks 1100 which are single or stacked (FIG. 5*b*) where the front surface 1100*a* is greatly inclined relative to this viewing direction and/or to the vertical, this inclination making the label difficult to read.

In this embodiment the two rear teeth 40 may be arranged in a substantially central position in the longitudinal direction X-X.

FIG. 6 shows a third embodiment of the label-holder element 210 where the rear face 210*c* has two teeth 240 which project outwards obliquely with respect to the two directions, i.e. longitudinal direction X-X and vertical direction Z-Z, and are elastically deformable in the said longitudinal direction X-X.

In this configuration the base 211 of the label holder extends outwards and comprises a central body 211*a* in which two incisions 211*b* suitable for engagement with the reliefs 25 of the underlying label-holder element 10,110 are formed.

In this configuration (FIG. 9) a base label-holder element 10,210 as illustrated in FIGS. 1, 5*a* and the element 210 described above may be coupled together by means of engagement of the teeth of the latter inside the opposite undercuts 23 of the former. In this way the assembly consisting of label-holder element 10 and label-holder element 210 is particularly suitable for insertion both on terminal blocks with dedicated seats and on terminal blocks provided with an adapter having any configuration.

In addition, the label-holder element 210 is particularly suitable (FIGS. 7,8) for allowing the engagement of connection elements 250—known in the sector by the term "straps"—in order to fasten together several label-holder elements, increasing the stability thereof and reducing the possibility of their becoming detached and falling or swapping of the wires and/or terminal blocks in the event of temporary removal and/or replacement during maintenance operations.

Fitting of the straps on the base label holder 10 would in fact not allow correct introduction of the label inside the respective seat.

FIGS. 10 to 12 show a fourth embodiment of the label-holder element 510 which in this case has top and bottom edges of the seat 20 formed in the manner of engaging means consisting of a block 522 which has an internal cavity 523 open laterally on one of the two sides 20*b* of the body 510 and extending depthwise in the transverse direction as far as the blind bottom face formed by the other side of the body 510.

Preferably the cavity 523 is formed in the manner of a first substantially trapezoidal space 523*a* with oblique sides 523*a* and connected to a second substantially I-shaped space 523*b*.

Said cavity 523 allows in this way insertion of teeth 540 extending outwards from the bottom surface of a label 530 and having a form matching that of the cavity 523.

In greater detail the teeth 540 have a head 540*a* integral with a straight shank 540*b*; the head 540*a* has a lateral relief 540*c*.

With this configuration each tooth may be displaced in the transverse direction Y-Y inside the cavity 523 and, once insertion has been completed, the lateral relief 540*c* interferes with inclined sides 523*c* of the cavity 523, preventing in this way the label from coming out in the transverse direction Y-Y.

The bottom surface 510*c* of the label 510 is formed in a manner similar to that of the label holder 210 and has the same elements 240,211*b*,211,211*a*—the above description of which is not repeated and is fully applicable here—in particular the teeth 240 for coupling with corresponding reliefs 111 defining a seat 101 of a terminal block 100 for mounting the label 530.

FIGS. 13-15 show a variation of embodiment of the label holder 510 in which the cavity 20 is further formed as solid parts 524 alternating with cavities 523, similar to those which act as engaging means 523 of the top edges 521, 522 of the seat 520 situated in the end position in the embodiment shown in FIGS. 10, 12, thus reproducing the configuration of the seats 101 present in the terminal block 100 as shown in FIGS. 3,4.

Although not shown, it is understood that the adapter/label assembly is assembled by inserting the bottom edge 30*b* of the latter into the bottom undercut 23 of the seat 20 so that the bottom tooth 22 of the same interferes with the bottom edge of the label 30; once the respective bottom edges have been engaged together, the label 30 is pushed frontally in the vertical direction Z-Z so as to force insertion of the top edge 30*a* of the label into the top undercut 23 of the seat 20 of the terminal block 10, causing interference between the top tooth 21 and the top edge 30*a* of the label; engagement together in the front direction being facilitated by the small relative sliding friction of the surfaces due to the rounded form of the teeth and edges which come into contact with each other.

Once frontal insertion of the label 30 has been completed, the cavity 35 thereof engages with the relief 25 of the seat 20, causing locking of the label also in the transverse direction Y-Y, the label being prevented from accidentally coming out in this direction.

As shown in particular in FIG. 16, the label-holder element has a laterally open seat 20 which allows insertion/extraction of a label 30 also from the sides and, in the case of an opening on both sides, both from the right and from the left, therefore also allowing the mounting of labels in strip form which can be inserted on blocks of label-holder elements arranged alongside each other in the transverse direction Y-Y in alignment with supporting terminal blocks in turn arranged alongside each other and/or coupled together in the transverse direction Y-Y.

In the specific application it is also possible to provide labels without a recess 35 since the force applied by the relief 25 on the label causes an elastic deformation which creates a reaction in the longitudinal direction X-X in the region of the teeth 21,22 and a friction in the transverse direction Y-Y on the projection such as to stably retain the label in the seat.

It is therefore clear how the label-holder element according to the invention is easy and low-cost to produce and is able to form a versatile assembly which may be easily mounted on different types of electric terminal block in a stable and therefore safe and reliable manner owing to at least one pair of teeth extending from the rear face and the particular structure of the label-holder seat and the possibility of using substantially flat standardized labels which have a uniform thickness and are made using different plastic and/or paper materials, as well as the possibility of both frontal and lateral and also, where necessary, multiple insertion.

Although described in connection with a number of embodiments and a number of preferred examples of embodiment of the invention, it is understood that the scope of protection of the present patent is determined solely by the claims below.

What is claimed is:

1. A label-holder element for electric switchboard terminal blocks, comprising:

a body extending in a longitudinal lengthwise direction, transverse widthwise direction and vertical thickness direction, wherein the body includes:

a front face provided with a seat for labels;

a rear face opposite the front face in the vertical direction;

side faces opposite to each other in the transverse direction;

at least one pair of teeth for coupling with a terminal block, extending outwards from the rear surface of the body;

wherein each tooth has an elasticity in the longitudinal direction for allowing the tooth to flex elastically in the longitudinal direction, wherein each tooth of at least one pair of coupling teeth has the form of an elongated "C" and an internal cavity (41) situated between the arms (40*a*) of said "C";

wherein the seat has a top edge and a bottom edge arranged opposite each other in the longitudinal direction and configured for engaging a label, and wherein the seat is open laterally in the transverse direction on at least one side to allow insertion/extraction of a label from at least one side of the seat.

2. The element as claimed in claim 1, wherein the top edge and bottom edge each have a respective tooth for engaging the label, wherein each tooth forms a corresponding undercut towards the inside of the seat.

3. The element as claimed in claim 2, wherein each tooth of the seat extends over the entire width of the seat in the transverse direction.

4. The element as claimed in claim 2, wherein the oppositely arranged teeth of the seat have a rounded edge.

5. The label-holder element as claimed in claim 1, comprising at least one relief extending in the vertical direction on the front surface of the seat.

6. The element as claimed in claim 5, wherein said at least one relief is arranged in a central position with respect to the transverse extension of the seat.

7. The label-holder element as claimed in claim 1, wherein the seat is open on both sides in the transverse direction for inserting the label from one side or the other side.

* * * * *